US007924234B2

(12) United States Patent
Christ

(10) Patent No.: US 7,924,234 B2
(45) Date of Patent: Apr. 12, 2011

(54) CLADDING FOR A MICROWAVE ANTENNA

(75) Inventor: Jochen Christ, Besigheim (DE)

(73) Assignee: Ericsson AB, Stockholm (SE)

( * ) Notice: Subject to any disclaimer, the term of this patent is extended or adjusted under 35 U.S.C. 154(b) by 351 days.

(21) Appl. No.: 12/090,175

(22) PCT Filed: Aug. 22, 2006

(86) PCT No.: PCT/EP2006/065536
§ 371 (c)(1),
(2), (4) Date: May 7, 2008

(87) PCT Pub. No.: WO2007/042340
PCT Pub. Date: Apr. 19, 2007

(65) Prior Publication Data

US 2008/0246683 A1 Oct. 9, 2008

(30) Foreign Application Priority Data

Oct. 14, 2005 (GB) ..... 0520890.5

(51) Int. Cl.
*H01Q 13/00* (2006.01)

(52) U.S. Cl. ..... 343/773; 343/792.5

(58) Field of Classification Search ..... 343/773, 343/792.5, 895
See application file for complete search history.

(56) References Cited

U.S. PATENT DOCUMENTS

| | | | | |
|---|---|---|---|---|
| 2,596,190 | A | 5/1952 | Wiley | |
| 3,618,104 | A * | 11/1971 | Behr | 343/745 |
| 4,786,911 | A * | 11/1988 | Svy | 343/785 |
| 6,317,101 | B1 * | 11/2001 | Dockery | 343/895 |
| 2003/0210207 | A1 * | 11/2003 | Suh et al. | 343/895 |

FOREIGN PATENT DOCUMENTS

| | | |
|---|---|---|
| JP | 57065901 | 4/1982 |
| WO | 2005/069435 | 7/2005 |
| WO | 2006/008314 | 1/2006 |

* cited by examiner

*Primary Examiner* — Tan Ho
(74) *Attorney, Agent, or Firm* — Coats & Bennett, P.L.L.C.

(57) ABSTRACT

A cladding (2) for a microwave antenna comprises at least one plate (3*a*, 3*b*, 3*c*, 3*d*) which has, in a first section plane (x=0; y=0), a cross section in the shape of a logarithmic spiral, characterized in that the plate (3*a*, 3*b*, 3*c*, 3*d*) has a cross section in the shape of a logarithmic spiral also in at least one second section plane perpendicular to the first one.

20 Claims, 6 Drawing Sheets

CLADDING FOR A MICROWAVE ANTENNA

The present invention relates to a cladding for a microwave antenna and to an assembly comprising such a cladding and a microwave antenna.

Microwave antennas, which may be highly directional antennas for point-to-point transmission or sector antennas for point-to-multipoint transmission, must often be cladded when installed on a building in order to protect them from rain, wind, dust etc. Such claddings inevitably have an influence on the radiation pattern of the antenna. A known technique to keep this influence small is to adapt the thickness of such a cladding plate to the vacuum wave-length of the radiation emitted by the antenna and to the dielectric constant $\epsilon_R$ of the plate material so that a beam which enters the plate at a first side of the cladding plate and is reflected at a second side thereof will interfere destructively with a portion of the beam which is directly reflected at the first side. A cladding of this type is described e.g. in DE 10 2004 002 374 A1.

This technique has the disadvantage that it works properly only if the thickness of the cladding is adapted to the wavelength of the beam and to the dielectric constant of the cladding material.

A different approach is taken in the applicant's German patent application 10 2004 035 614, not prepublished. This document suggests to use a cladding plate of spiral-shaped cross section. If an antenna is located at the vortex of the spiral, beams from the antenna are incident on the spiral at equal angles, regardless of the direction in which they propagate from the antenna. If the polarisation of the antenna radiation is in the section plane and the angle of incidence is the Brewster angle, there is no reflection from the cladding plate. Since the dielectric constant $\epsilon_R$ and, accordingly, the Brewster angle vary little with wavelength, a cladding of this type is useful for a broad range of antenna wavelengths. However, the Brewster effect exists only for radiation polarised in the plane of incidence, i. e. p-polarised radiation, whereas for s-polarised radiation, reflection cannot be suppressed. Accordingly, if the cladding of the above cited application is used with a dual-polarised antenna, reflection will be suppressed for only one of its two polarisations.

One might think that if reflection can be suppressed for a beam polarised in a first plane by placing the cladding under the Brewster angle in this first plane, reflection of a beam propagating in the same direction as the first but polarised in a second plane perpendicular to the first might be suppressed by tilting the plate also in the polarisation place of the second beam, so that it intersects both planes at the Brewster angle. However, if this is done, neither of the two beams is indeed polarised in the propagation plane defined by the incident and reflected beams. Instead, in this propagation plane both beams have parallel and perpendicular components. So, obviously, the Brewster condition cannot be simultaneously fulfilled for two beams from a dual-polarised antenna polarised in mutually perpendicular planes.

Surprisingly, simulations have nevertheless shown that very low degrees of reflection can be achieved at a cladding plate having a cross section in the shape of a logarithmic spiral in two section planes oriented perpendicular to each other.

The spirals of the two section planes should preferably have a common vortex defined as the point of radius r=0, the radius r of the spirals being given by $r(\phi)=r_1*e^{a\phi}$, and $r(\psi)=r_4*e^{a\psi}$, respectively, wherein $\phi$, $\psi$ are angles in the first and second section planes, respectively, and $r_1$, $r_2$ and a are constants.

According to a first embodiment, $r_1$ equals $r_2$, and the shape of the plate is given by $r(\phi, \psi)=r_1*\exp(a\sqrt{\phi^2+\psi^2})$.

Such a shape is e.g. obtained by rotating the spiral around an axis which extends through the vortex.

According to this embodiment, in any section plane extending through the axis, the Brewster condition is fulfilled exactly for radiation polarised in that plane, whereas for radiation polarised in the section plane which reaches the cladding outside the section plane, the Brewster condition is not fulfilled exactly.

According to a second embodiment, for which still better reflection characteristics were found, the shape of the plate is given by $r(\phi, \psi)=r_0*e^{a\phi}*e^{\psi}$.

The constant a preferably is the square root of the dielectric constant $\epsilon_R$ of the material of the plate.

In order to make the cladding compact and/or to adapt it for an assembly comprising more than one antenna, the cladding may be formed of a plurality of continuously joined plates that have the spiral-shaped cross section explained above.

If a pair of such plates is assigned to a same antenna, the spiral sections of the pair should have their vortex in common.

The plates of such a pair are preferably joined in a first junction plane extending through the vortex. In this case, one of the plates may be the specular image of the other, whereby manufacture of the plate and the formation of a smooth, continuous junction is facilitated.

Further, pairs of said plates are joined along a second junction plane extending through the common vortex perpendicular to the first junction plane. Such a cladding may e.g. be formed of four plates of identical shape.

The first junction plane may be the first section plane, or it may bisect an angle formed by said first and second section planes.

Further features and advantages of the invention become apparent from the subsequent description of embodiments thereof, referring to the appended drawings.

Figure 9:
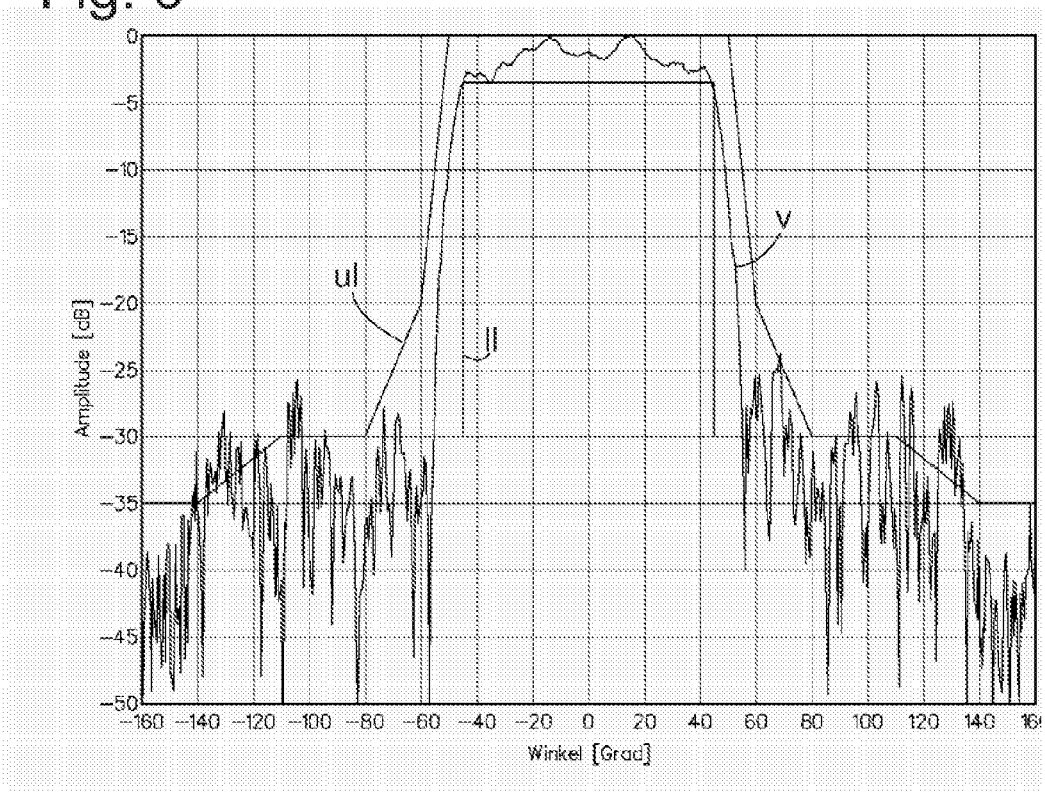
FIG. 9 is a radiation characteristic of an antenna assembly comprising the antenna of FIG. 7 and a cladding according to the present invention, in the case of vertical polarisation.
Figure 10:
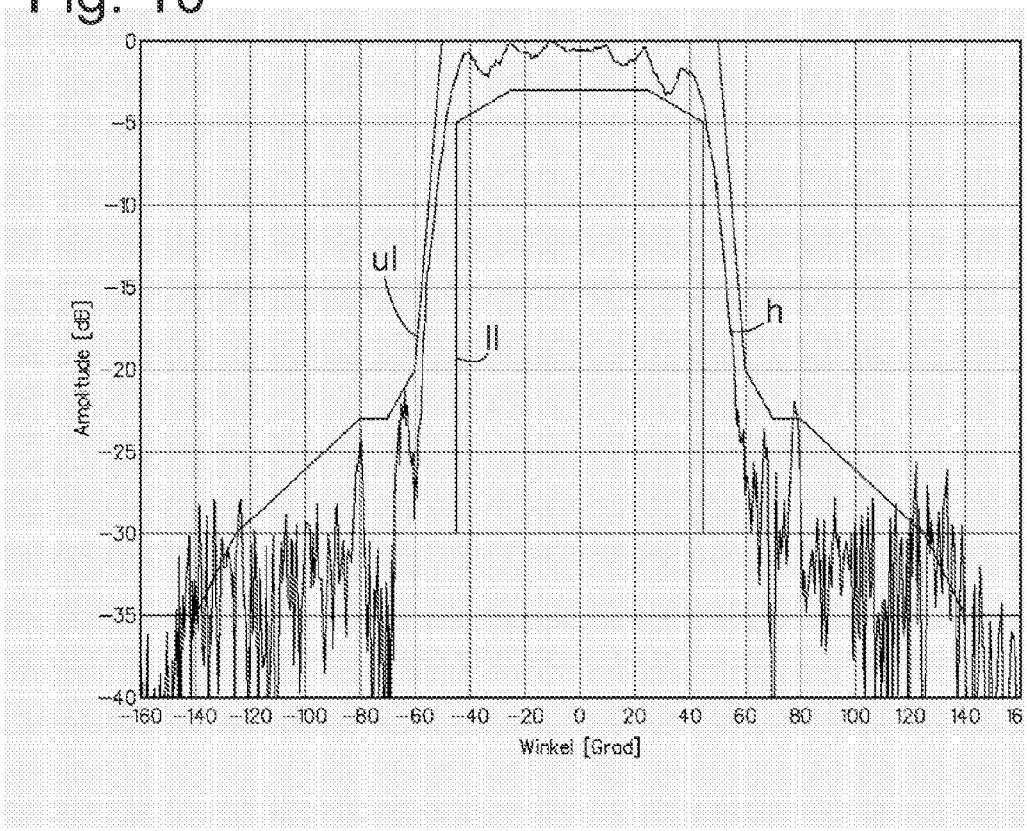
FIG. 10 is a radiation characteristic of the same assembly as in FIG. 9, in case of horizontal polarisation of the antenna.
Figure 11:
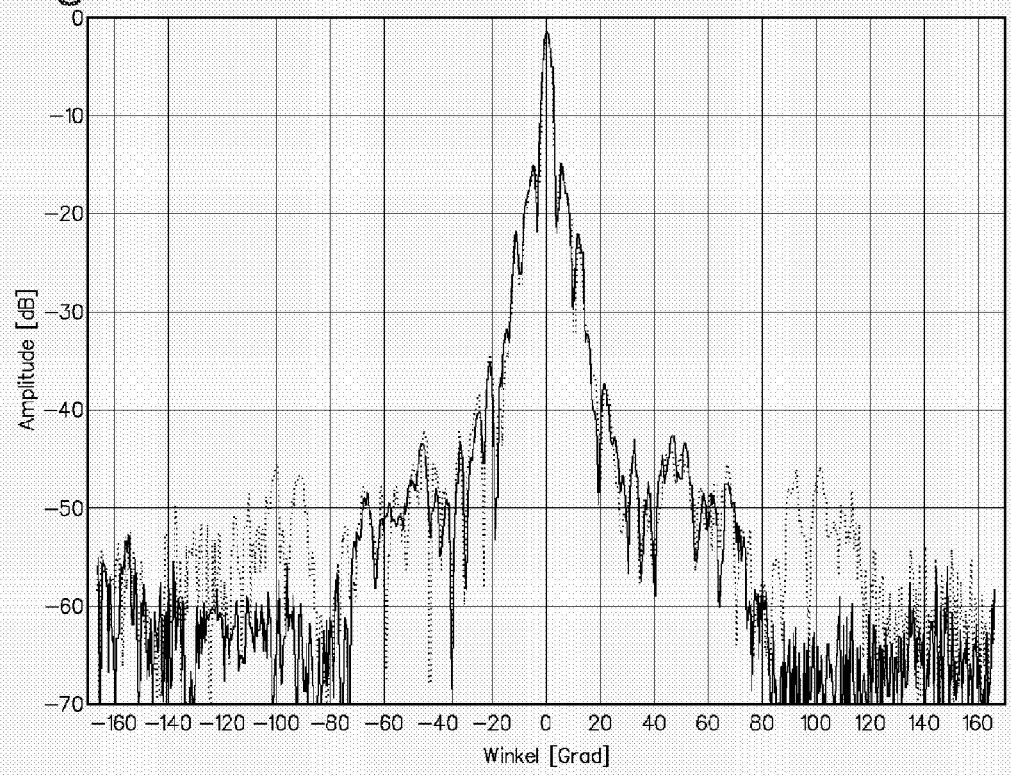
FIG. 11 shows radiation characteristics of a vertically polarised parabolic antenna, both alone and in combination with the cladding of FIG. 1.
Figure 12:
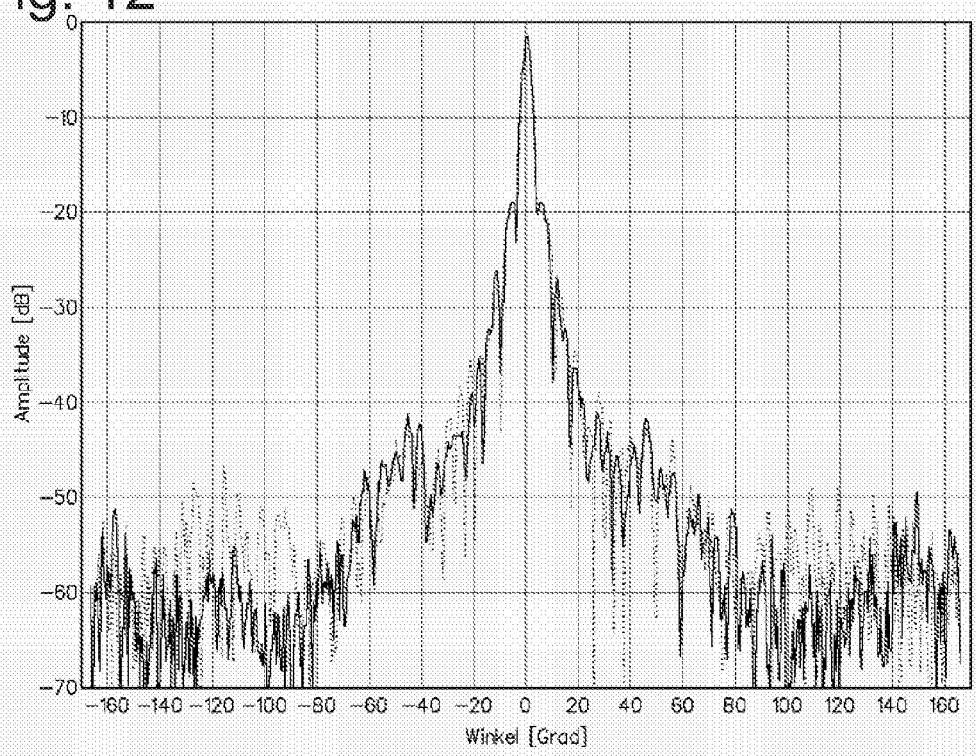
Figure 13:
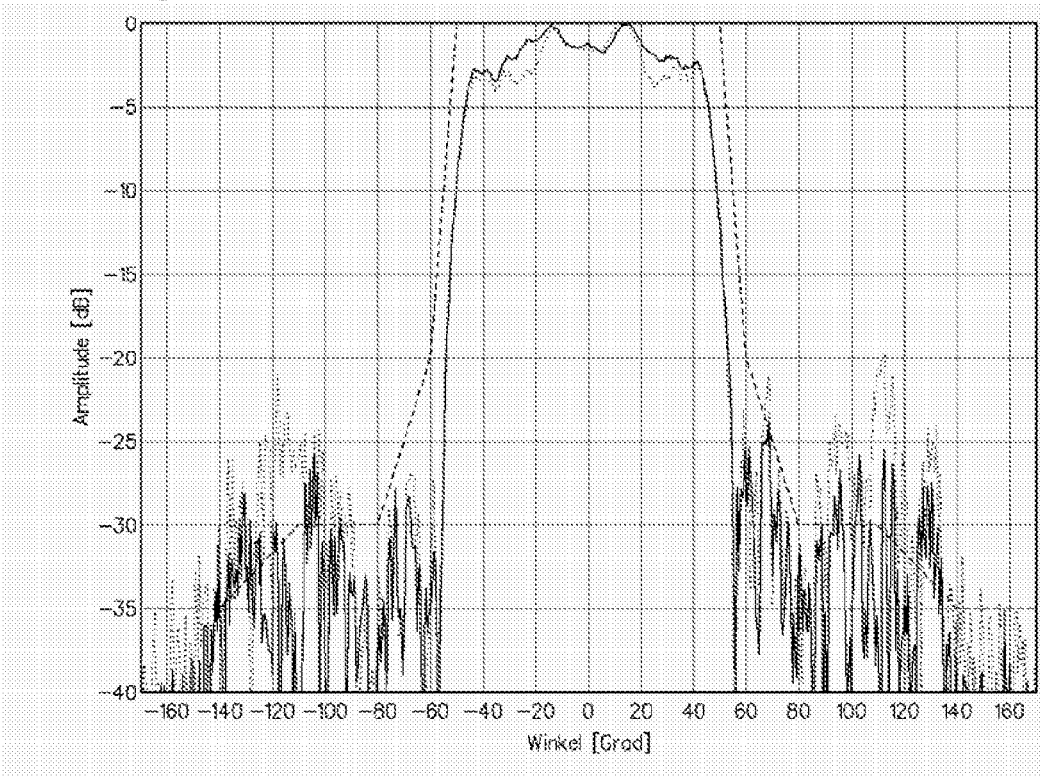
Figure 14:
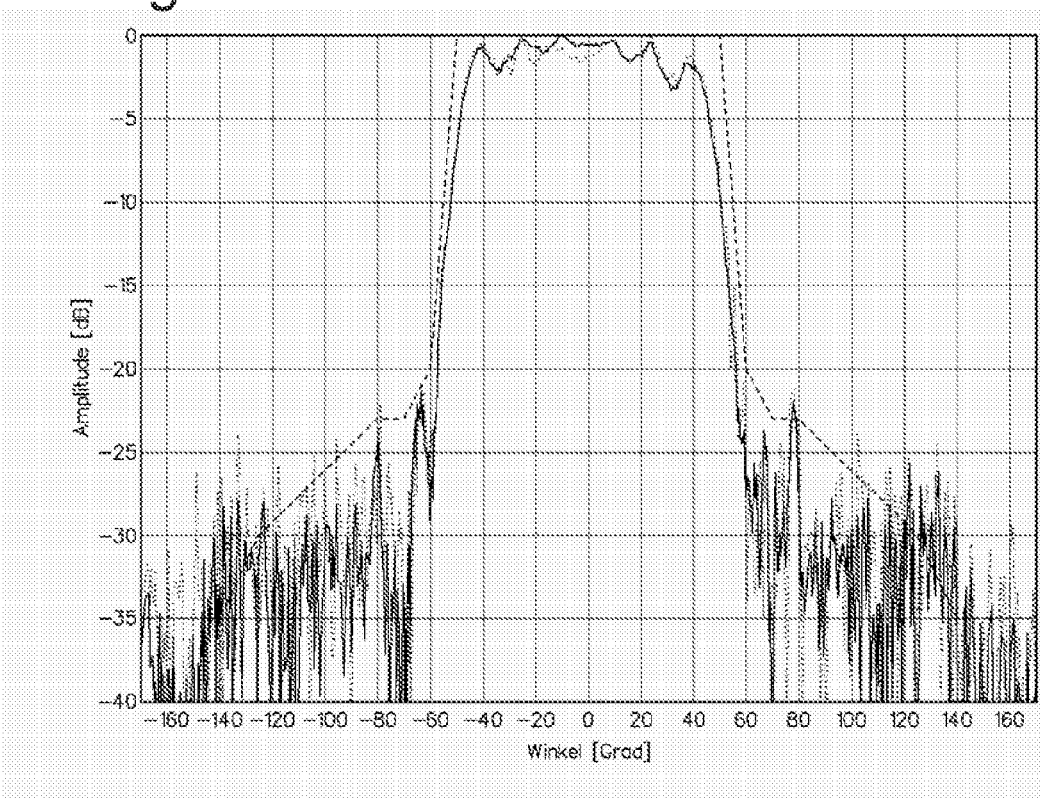

FIG. 12, analogous to FIG. 11, shows radiation characteristics of a horizontally polarised parabolic antenna;

FIG. 13 shows radiation characteristics of the same assembly as in FIG. 9, for a dry cladding and a wet cladding; and FIG. 14 shows radiation characteristics of the same assembly as in FIG. 10, for a dry cladding and a wet cladding.

Figure 1:
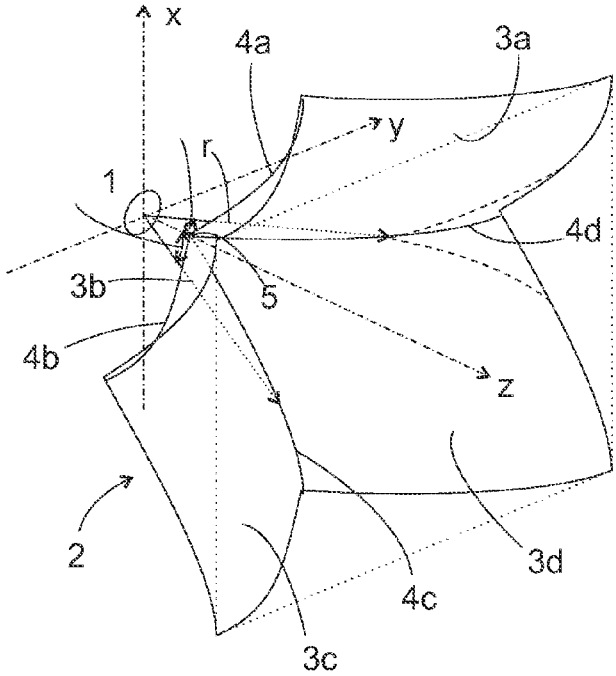
FIG. 1 is schematic perspective view of an antenna assembly according to a first embodiment of the invention.

In FIG. 1, a microwave antenna, e.g. a 90° sector antenna, is denoted by 1, and 2 is a cladding through which antenna 1 radiates. Antenna 1 is located at the origin x=y=z=0 of a Cartesian coordinate system having axes x, y and z, the positive z direction coinciding with the main beam direction of the antenna 1. Antenna cladding 2 is formed of four plates 3*a, b, c, d* which are joined to each other continuously in planes x=0 and y=0. In these two planes, the cladding plates 3*a* to 3*d* have a section in the shape of a logarithmic spiral, the shape of which may be described e.g. by the formula $r(\phi)=r_1*\exp(a|\phi|)$ or $r(\psi)=r_1*\exp(a|\psi|)$, wherein $\phi$, $\psi$ are angles formed between the z axis and a radius vector of a point of edges 4*d*, 4*b* or 4*a*, 4*c* measured in the plane x=0 or the plane y=0, respectively, $r_1$ is the distance between an apex 5 of the cladding 2 at $\phi=\psi=0$(x=y=0) and the origin, and $r(\phi)$ or $r(\psi)$ is the distance from the origin of the point at angle $\phi$ or $\psi$.

It is a characteristic of the logarithmic spiral that at any point of it, the angle of the radius vector of that point and the tangent at that point is constant. If $a=\sqrt{\epsilon_R}$, $\epsilon_R$ being the dielectric constant of the material of the plates 3*a* to *d*, radiation from the antenna 1 is incident under the Brewster angle of the plate material at any point of the edges 4*a* to 4*d*.

Figure 2:
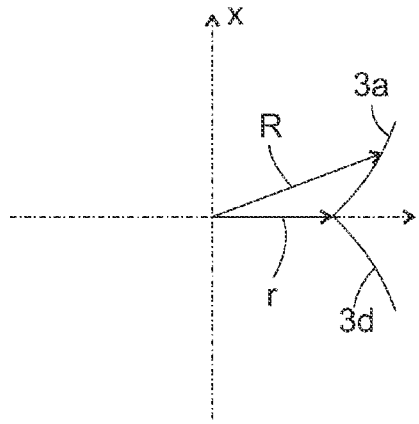
FIG. 2 is a section of the cladding of FIG. 1.

Outside the planes x=0 and y=0, the shape of the cladding 2 is defined by the requirement that its cross sections are logarithmic spirals in any section plane extending through the x axis. FIG. 2 shows such a cross section taken in the plane defined by the x axis and the vector r of FIG. 1. Here the shape of the spirals is given by $r(\psi)=r_2*\exp(a|\psi|)$, wherein $\psi$ is an angle between the vector r in the plane x=0 and the radius of a point on the spiral in the section of FIG. 2.

Accordingly, any point on the surface of the cladding can be identified by two angles $\phi$, $\psi$, the angle $\psi$ being formed between the radius vector R of the point and the plane x=0, and $\phi$ being the angle between projection r of R into the plane x=0 and the z axis. The distance of each such point from the origin of the coordinate system is then given by $r(\phi, \psi)=r_C*e^{a\phi}*e^{a\psi}$.

Quite equivalently, $\phi$ might be defined as the angle between vector R and its projection onto the plane y=0 and $\psi$ as the angle between this projection and the z axis.

Another alternative is to define $\phi$ as the angle between the z axis and the projection of R into the plane x=0, and $\psi$ as the angle between the z axis and the projection of R into the plane y=0. For small values $\phi$, $\psi$, differences in the shape of the cladding plates resulting from these three different definitions are negligible. At large values of $\phi$, $\psi$, the intensity of radiation is much smaller than for the main beam direction, $\phi=\psi=0$, so that variations of shape there have little influence on the radiation pattern of the antenna assembly of FIG. 1.

If it is assumed that antenna 1 is a dipole extending in the y direction, the electric field vector generated by it at any point of the plane x=0 will be oriented in that plane. I.e., radiation incident at the edge 4*d* between cladding plates 3*a*, 3*d* is p-polarised and is incident under the Brewster angle, so that there is no reflection. On the other hand, if the antenna is assumed to be a dipole in the x-direction, the electric field is polarised in the x-direction at any point of the plane x=0 and its surroundings, and radiation which is incident on the cladding plates 3*a*, 3*d* little above or below the edge 4*d* is practically completely p-polarised in the section plane of FIG. 2 and is also incident at the Brewster angle there, so that reflection is efficiently suppressed for this polarisation, too. Therefore, the cladding of FIG. 1 has excellent reflection characteristics regardless of the polarisation direction of antenna 1.

Figure 3:
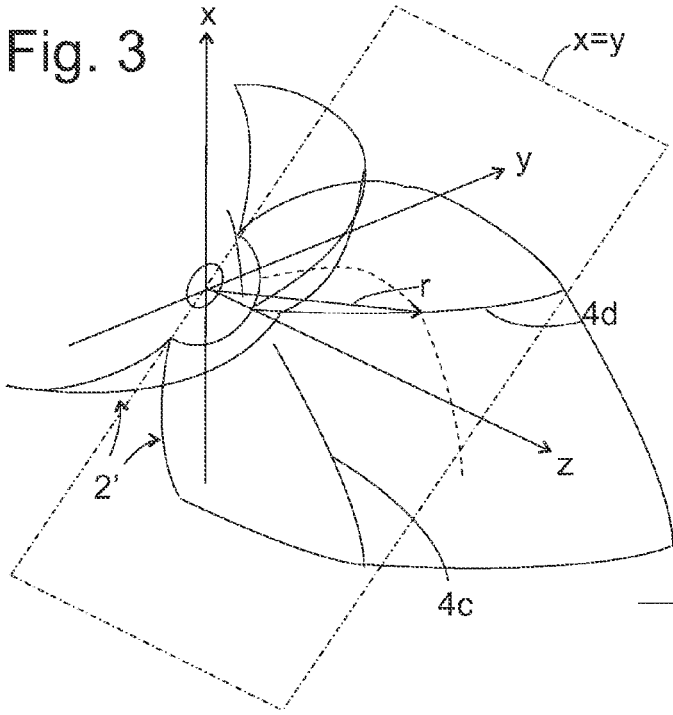
FIG. 3 is a perspective view of an antenna assembly according to a second embodiment.
Figure 4:
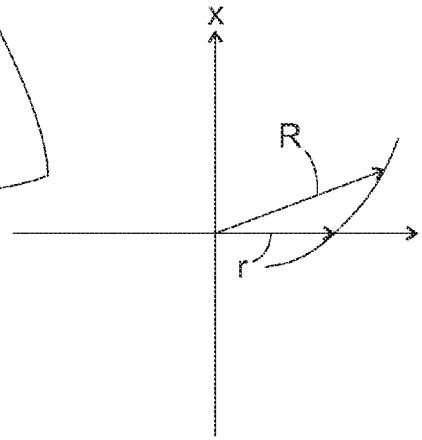
FIG. 4 is a section of the antenna cladding of FIG. 3.

FIG. 3 illustrates a second embodiment of the antenna assembly of the present invention. In regions x>0, y<0 and x<0, y>0, respectively, the shape of cladding 2' of FIG. 3 is identical to plates 3*b*, 3*d*, respectively, of FIG. 1. The shape of the intersections of the cladding 2' and the plane x=0 or y=0, respectively, is the same as in FIG. 1, so that the intersection curves are denoted 4*a* to 4*d* in FIG. 3, too. However, in contrast to the cladding 2, the cladding 2' is continuous in the vicinity of intersection curves 4*a* to 4*d;* there are no acute edges. The shape of the cladding 2' in regions x>0, y>0 and x<0, y<0, respectively, is defined by the requirement that in each section plane extending through the x axis, one continuous spiral shall extend from the plane x=y, as shown in the section of FIG. 4.

The cladding 2' may conveniently by formed of two shells joined along the x=y plane.

Like in the embodiment of FIG. 1, in the plane x=0, electric fields polarised in that plane as well as those polarised perpendicular thereto "see" Brewster angles at the cladding 2'.

A cladding according to a third embodiment, not shown, might have the shape shown in FIG. 3 in regions x>0, y>0 and x<0, y<0, and specular images of these shapes, reflected at planes x=0 or y=0, in regions x>0, y<0 and x<0, y>0, respectively. Again, reflection conditions are similar to those of the embodiments of FIGS. 1 and 3.

Figure 5:
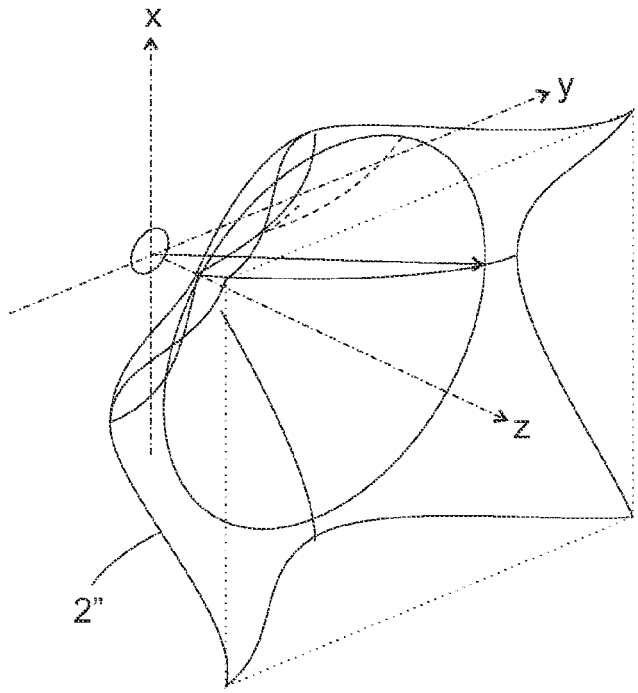
FIG. 5 is a schematic perspective view of an antenna assembly according to a third embodiment.

According to a fourth embodiment shown in FIG. 5, the shape of the cladding 2" is obtained by rotating a spiral around the z axis. With such a cladding shape, any beam incident on the cladding 2" from antenna 1 forms a Brewster angle with the surface normal of the cladding 2" at its point of incidence. However, reflection characteristics of this cladding have been found to be somewhat inferior to those of the embodiment of FIG. 1.

Figure 6:
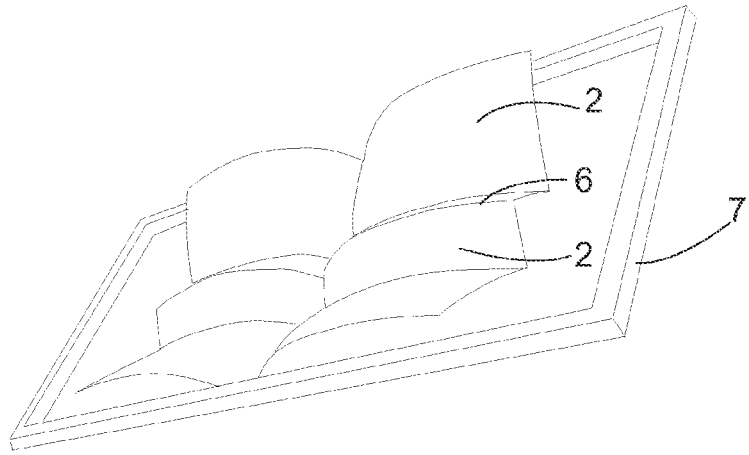
FIG. 6 is a perspective view of a cladding for a stacked antenna.

In many applications, more than one antenna has to be placed one above the other at a same location. FIG. 6 show a cladding for such a stacked antenna assembly, formed of two claddings 2 of the type shown in FIG. 1 which are joined at their edges 6 and mounted in a common frame 7.

Figure 7:
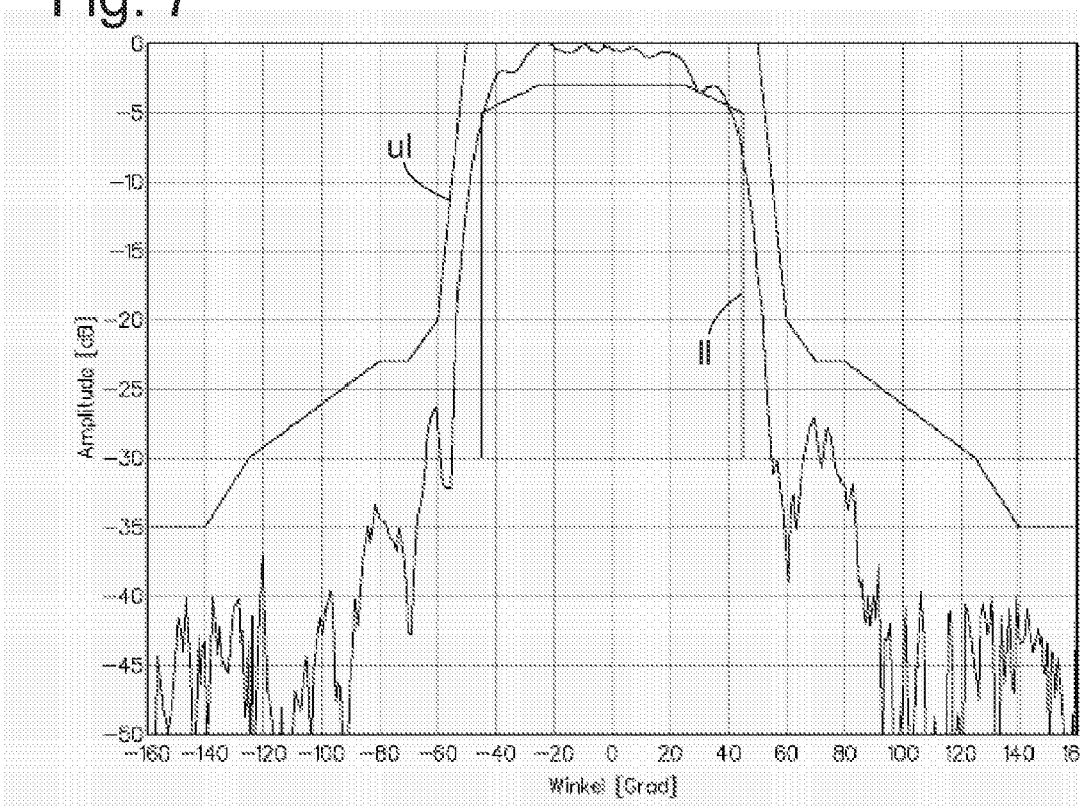
FIG. 7 is a radiation characteristic of an uncladded antenna.

The effectiveness of the antenna claddings of the present invention is illustrated by means of the radiation characteristics of FIGS. 7 to 10. FIG. 7 is the azimuth characteristic of a conventional 90° sector antenna, uncladded. Desired upper and lower limits of the radiation amplitude are indicated by lines u1, 11.

Figure 8:
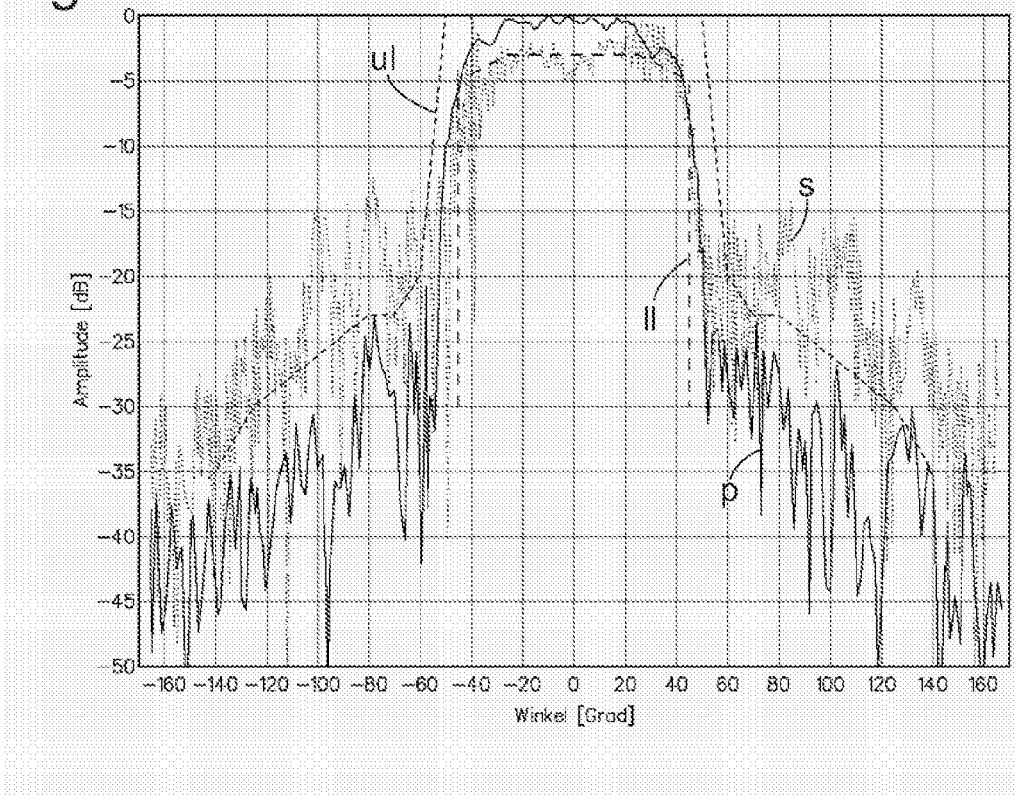
FIG. 8 shows a radiation characteristic of an antenna assembly comprising the antenna of FIG. 7 and a cladding according to DE 10 2004 035 614.

FIG. 8 illustrates the radiation characteristic of the same sector antenna in an assembly with the cladding according to DE 10 2004 035 614, both for a first polarisation of the antenna adapted to the orientation of the cladding, and for a second antenna polarisation perpendicular to the first one. For the first polarisation of the antenna represented by a solid curve p in FIG. 8, the radiation amplitude is well within the limits u1, 11; in case of the second polarisation represented by dotted curve s, the characteristic is seriously degraded.

FIGS. 9 and 10 show radiation characteristics of an antenna assembly comprising the same sector antenna as in FIGS. 7, 8 and the cladding of the type shown in FIG. 1, for vertical and horizontal polarisations, i.e. along the x and y axis in the coordinate system of FIG. 1, respectively. For both polarisations, the characteristic curve v, h is found to be well inside the limits u1, 11.

Of course, the cladding of the present invention is also applicable to other types of antennas. E.g. FIGS. 11 and 12 show two radiation characteristics each, one of which, represented by a solid line, corresponds to a parabolic antenna alone and the other, represented by a dotted line, corresponds to the same parabolic antenna combined with the cladding of FIG. 1. In FIG. 11, the polarisation is vertical, in FIG. 12 it is horizontal. The influence of the cladding on the characteristic is so small that in neither of the two FIGs., the two curves can be clearly distinguished from one another.

Conventional antenna claddings having a thickness adapted to the radiation wavelength are highly sensitive to raindrops on their surface. Since these increase the effective thickness of the cladding, they cause substantial reflection to occur. A remarkable feature of the claddings of the present invention is that the Brewster effect made use of in these does not depend on the thickness of the cladding. Therefore, raindrops have hardly a noticeable influence on the radiation characteristic of an antenna assembly according to the present invention. This is illustrated by FIGS. 13, 14. Each of these shows two radiation characteristics of the same 90° sector antenna as in FIGS. 7 to 10 combined with the cladding of FIG. 1, one, represented by a solid curve, for a dry cladding and the other one, represented by a dotted curve, for a wet one. In FIG. 13 the polarisation is vertical, in FIG. 14 it is horizontal. In either case the influence of the water drops is so small that the two curves cannot be clearly distinguished.

The invention claimed is:

1. A cladding for a microwave antenna, the cladding comprising:

at least one plate having a first section plane and at least one second section plane perpendicular to the first section plane; and the plate having a cross section in the shape of a logarithmic spiral in each of the first and second section planes.

2. The cladding of claim 1 wherein:

the logarithmic spirals of the first and second section planes have a common vortex at r=0; and the radius r of the spirals is given by $r(\phi)=r_1*e^{a\Phi}$ and $r(\psi)=r_2e^{a\psi}$, respectively, where $\phi$, $\psi$ are angles in the first and second section planes, respectively, and $r_1$, $r_2$ and a are constants.

3. The cladding of claim 2 wherein $r_1=r_2$, and wherein the plate has a shape given by $r(\phi,\psi)=r_1*\exp(a\sqrt{\phi^2+\psi^2})$, where a is the square root of the dielectric constant $\in_R$ of the material of the plate.

4. The cladding of claim 2 wherein the plate has a shape given by $r(\phi,\psi)=r_0*e^{a\Phi}*e^{a\psi}$, where a is the square root of the dielectric constant $\in_R$ of the material of the plate.

5. The cladding of claim 1 further comprising a plurality of continuously joined plates, each plate having a cross section in the shape of a logarithmic spiral.

6. The cladding of claim 5 wherein the logarithmic spiral-shaped sections of a pair of the continuously joined plates have a common vortex at r=0.

7. The cladding of claim 6 wherein the pair of plates is joined in a first junction plane (x=0; x=y) extending through the vortex.

8. The cladding of claim 7 wherein the pair of plates is further joined along a second junction plane (y=0) extending through the common vortex (r=0) perpendicular to the first junction plane (x=0).

9. The cladding of claim 7 wherein the first junction plane is the first section plane.

10. The cladding of claim 7 wherein the first junction plane (x=y) bisects an angle formed by the first and second section planes (x=0, y=0).

11. An antenna assembly comprising:

a cladding comprising:

a plate having a first section plane and a second section plane perpendicular to the first section plane; and the plate having a cross section in the shape of a logarithmic spiral in each of the first and second section planes; and an antenna positioned at a common vortex of the logarithmic spirals.

12. The antenna assembly of claim 11 wherein:

the logarithmic spirals of the first and second section planes have a common vortex at r=0; and the radius r of the logarithmic spirals of the first and second section planes is given by $r(\phi)=r_1*e^{a\psi}$ and $r(\psi)=r_2e^{a\psi}$, respectively, with $\phi$, $\psi$ being angles in the first and second section planes, respectively, and $r_1$, $r_2$ and a being constants.

13. The antenna assembly of claim 12 wherein $r_1=r_2$, and wherein the plate has a shape given by $r(\phi,\psi)=r_1*\exp(a\sqrt{\phi^2+\psi^2})$, where a is the square root of the dielectric constant $\in_R$ of the material of the plate.

14. The antenna assembly of claim 12 wherein the plate has a shape given by $r(\phi,\psi)=r_0*e^{a\Phi}*e^{a\psi}$, where a is the square root of the dielectric constant $\in_R$ of the material of the plate.

15. The antenna assembly of claim 11 wherein the cladding further comprises a plurality of continuously joined plates, each plate having a cross section in the shape of a logarithmic spiral.

16. The antenna assembly of claim 15 wherein the logarithmic spiral-shaped sections of a pair of the continuously joined plates have a common vortex at r=0.

17. The antenna assembly of claim 16 wherein the pair of plates is joined in a first junction plane (x=0; x=y) extending through the vortex.

18. The antenna assembly of claim 17 wherein the pair of plates is further joined along a second junction plane (y=0) extending through the common vortex (r=0) perpendicular to the first junction plane (x=0) .

19. The antenna assembly of claim 17 wherein the first junction plane is the first section plane.

20. The antenna assembly of claim 17 wherein the first junction plane (x=y) bisects an angle formed by the first and second section planes (x=0, y=0).

* * * * *

UNITED STATES PATENT AND TRADEMARK OFFICE

CERTIFICATE OF CORRECTION

PATENT NO. : 7,924,234 B2
APPLICATION NO. : 12/090175
DATED : April 12, 2011
INVENTOR(S) : Christ It is certified that error appears in the above-identified patent and that said Letters Patent is hereby corrected as shown below:

In Fig. 7, Sheet 3 of 6, after "140", delete "16" and insert -- 160 --, therefor.

In Fig. 9, Sheet 4 of 6, after "140", delete "16" and insert -- 160 --, therefor.

In Fig. 10, Sheet 4 of 6, after "140", delete "16" and insert -- 160 --, therefor.

In Fig. 12, Sheet 5 of 6, delete "Ampltude" and insert -- Amplitude --, therefor.

In Column 1, Line 64, before "and", delete ",".

In Column 3, Lines 35-36, delete " $r(\phi,\psi)=r_C*e^{a\phi}*e^{a\psi}$. " and insert -- $r(\phi,\psi)=r_0*e^{a\phi}*e^{a\psi}$. --, therefor.

In Column 4, Line 41, delete "u1, 11." and insert -- ul, ll. --, therefor.

In Column 4, Line 49, delete "u1, 11;" and insert -- ul, ll; --, therefor.

In Column 4, Line 57, delete "u1, 11." and insert -- ul, ll. --, therefor.

In Column 6, Line 22, in claim 12, delete " $r(\phi)=r_1*e^{a\psi}$ " and insert -- $r(\varphi)=r_1*e^{a\varphi}$ --, therefor.

Signed and Sealed this
Eighth Day of January, 2013

David J. Kappos

David J. Kappos
*Director of the United States Patent and Trademark Office*